US008989641B2

(12) United States Patent
Ikeda

(10) Patent No.: US 8,989,641 B2
(45) Date of Patent: Mar. 24, 2015

(54) FIXING DEVICE WITH MECHANISM CAPABLE OF MINIMIZING GLOSSY STREAKS AND STAIN ON RECORDING MEDIUM AND IMAGE FORMING APPARATUS INCORPORATING SAME

(75) Inventor: Tamotsu Ikeda, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 205 days.

(21) Appl. No.: 13/485,138

(22) Filed: May 31, 2012

(65) Prior Publication Data

US 2013/0004216 A1 Jan. 3, 2013

(30) Foreign Application Priority Data

Jun. 28, 2011 (JP) ..... 2011-143304

(51) Int. Cl.
*G03G 15/20* (2006.01)

(52) U.S. Cl.
CPC ..... *G03G 15/2025* (2013.01); *G03G 15/2028* (2013.01); *G03G 15/2039* (2013.01)
USPC ..... 399/327

(58) Field of Classification Search
CPC ..... G03G 15/2025; G03G 15/2028; G03G 15/2075; G03G 15/2085
USPC ..... 399/323, 327
See application file for complete search history.

(56) References Cited

U.S. PATENT DOCUMENTS

| | | | | |
|---|---|---|---|---|
| 6,243,558 | B1 * | 6/2001 | Oota | 399/326 |
| 7,477,867 | B2 * | 1/2009 | Hiraoka et al. | 399/327 |
| 7,542,710 | B2 * | 6/2009 | Shinkawa et al. | 399/327 |
| 8,107,864 | B2 | 1/2012 | Saito et al. | |
| 8,202,600 | B2 * | 6/2012 | Okada et al. | 428/91 |
| 8,483,590 | B2 * | 7/2013 | McNamee et al. | 399/99 |
| 8,611,801 | B2 * | 12/2013 | Nakamura et al. | 399/327 |
| 2009/0129836 | A1 | 5/2009 | Sakaya et al. | |
| 2009/0297233 | A1 * | 12/2009 | Kameda | 399/322 |
| 2010/0034548 | A1 | 2/2010 | Naitoh et al. | |
| 2010/0239297 | A1 | 9/2010 | Sakaya et al. | |
| 2012/0002997 | A1 | 1/2012 | Hiraoka et al. | |
| 2012/0063829 | A1 | 3/2012 | Matsuyama et al. | |
| 2012/0195652 | A1 | 8/2012 | Takahashi et al. | |

FOREIGN PATENT DOCUMENTS

| | | |
|---|---|---|
| JP | 2006-154540 | 6/2006 |
| JP | 2008-40365 | 2/2008 |

* cited by examiner

*Primary Examiner* — Gregory H Curran
(74) *Attorney, Agent, or Firm* — Oblon, McClelland, Maier & Neustadt, L.L.P.

(57) ABSTRACT

A fixing device includes a fixing rotary body rotatable in a predetermined direction of rotation; an opposed rotary body contacting the fixing rotary body to form a fixing nip therebetween through which a recording medium bearing a toner image is conveyed; a plurality of separation pawls separatably contacting an outer circumferential surface of the fixing rotary body to separate the recording medium discharged from the fixing nip from the fixing rotary body; a temperature detector contacting the outer circumferential surface of the fixing rotary body to detect a temperature of the fixing rotary body; and a fixing rotary body cleaner interposed between the plurality of separation pawls and the temperature detector in the direction of rotation of the fixing rotary body and contacting the outer circumferential surface of the fixing rotary body to clean the outer circumferential surface of the fixing rotary body.

14 Claims, 7 Drawing Sheets

FIXING DEVICE WITH MECHANISM CAPABLE OF MINIMIZING GLOSSY STREAKS AND STAIN ON RECORDING MEDIUM AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2011-143304, filed on Jun. 28, 2011, in the Japanese Patent Office, the entire disclosure of which is hereby incorporated by reference herein.

BACKGROUND OF THE INVENTION

1. Field of the Invention

Exemplary aspects of the present invention relate to a fixing device and an image forming apparatus, and more particularly, to a fixing device for fixing a toner image on a recording medium and an image forming apparatus incorporating the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

FIG. 1 illustrates a fixing device 110 installed in such image forming apparatuses, which includes a fixing roller 101 and a pressing roller 102 that apply heat and pressure to a recording medium P bearing a toner image. For example, the pressing roller 102 is pressed against the fixing roller 101 heated by a heater 106 disposed inside the fixing roller 101 to form a fixing nip N therebetween through which the recording medium P bearing the toner image is conveyed. As the fixing roller 101 and the pressing roller 102 rotate and convey the recording medium P through the fixing nip N in a recording medium conveyance direction D, the fixing roller 101 and the pressing roller 102 apply heat and pressure to the recording medium P, melting and fixing the toner image on the recording medium P.

A thermistor 112 contacts the outer circumferential surface of the fixing roller 101 to detect the temperature of the fixing roller 101 so that a controller controls the heater 106 to heat the fixing roller 101 to a desired temperature based on the temperature detected by the thermistor 112. Additionally, a plurality of separation pawls 111 contacts the outer circumferential surface of the fixing roller 101 to separate the recording medium P discharged from the fixing nip N from the fixing roller 101. FIG. 2 illustrates the arrangement of the thermistor 112 and the separation pawls 111. As shown in FIG. 2, the four separation pawls 111 and the single thermistor 112 are aligned in the axial direction of the fixing roller 101.

As the recording medium P bearing the toner image is conveyed through the fixing nip N, toner of the toner image may adhere from the recording medium P to the fixing roller 101 due to heat from the fixing roller 101. As the separation pawls 111 and the thermistor 112 slide over the rotating fixing roller 101, they scratch toner adhered to the fixing roller 101. Conversely, bands on the outer circumferential surface of the fixing roller 101 where the separation pawls 111 and the thermistor 112 do not slide over the fixing roller 101 continue carrying toner adhered from the toner image on the recording medium P, producing toner streaks on the outer circumferential surface of the fixing roller 101 as shown in FIG. 2. Accordingly, as the subsequent recording medium P is conveyed through the fixing nip N, the toner streaks produced on the fixing roller 101 are transferred onto the subsequent recording medium P, producing glossy streaks 113 on the subsequent recording medium P as shown in FIG. 2. Further, toner caught and accumulated by the separation pawls 111 and the thermistor 112 may fall onto the fixing roller 101 and may be further transferred from the fixing roller 101 onto the recording medium P, thus staining the recording medium P.

FIG. 3 is a graph illustrating a relation between the number of prints performed by the fixing device 110 shown in FIG. 1 and a level of glossy streaks that appear on recording media P. As shown in FIG. 3, the greater the glossy streak level, the smaller the amount of glossy streaks that appear on the recording media P. By contrast, the smaller the glossy streak level, the greater the amount of glossy streaks that appear on the recording media P. The dotted line defines the acceptable limit of the gloss streak level of 3.5. As the number of prints increases, the glossy streak level deteriorates. Specifically, with the number of prints of 2,000 sheets or more, the glossy streak level is below the acceptable limit of 3.5.

To address the above-described drawbacks of the fixing device 110, a fixing device that removes toner adhered from the recording medium P to the fixing roller 101 is proposed. For example, the fixing device includes a sliding roller that slides over the outer circumferential surface of a fixing roller to pick up toner therefrom and a cleaning roller that picks up toner from the sliding roller. However, the sliding roller sliding over the fixing roller may damage the outer circumferential surface of the fixing roller.

SUMMARY OF THE INVENTION

This specification describes below an improved fixing device. In one exemplary embodiment of the present invention, the fixing device includes a fixing rotary body rotatable in a predetermined direction of rotation; an opposed rotary body contacting the fixing rotary body to form a fixing nip therebetween through which a recording medium bearing a toner image is conveyed; a plurality of separation pawls separatably contacting an outer circumferential surface of the fixing rotary body to separate the recording medium discharged from the fixing nip from the fixing rotary body; a temperature detector contacting the outer circumferential surface of the fixing rotary body to detect a temperature of the fixing rotary body; and a fixing rotary body cleaner interposed between the plurality of separation pawls and the temperature detector in the direction of rotation of the fixing rotary body and contacting the outer circumferential surface of the fixing rotary body to clean the outer circumferential surface of the fixing rotary body.

This specification further describes below an improved fixing device. In one exemplary embodiment of the present invention, the fixing device includes a fixing rotary body rotatable in a predetermined direction of rotation; an opposed rotary body contacting the fixing rotary body to form a fixing nip therebetween through which a recording medium bearing a toner image is conveyed; a plurality of separation pawls separatably contacting an outer circumferential surface of the fixing rotary body to separate the recording medium discharged from the fixing nip from the fixing rotary body; a temperature detector contacting the outer circumferential surface of the fixing rotary body to detect a temperature of the fixing rotary body; a plurality of first fixing rotary body cleaners interposed between the plurality of separation pawls and the temperature detector in the direction of rotation of the fixing rotary body and contacting the outer circumferential surface of the fixing rotary body to clean the outer circumferential surface of the fixing rotary body; and a plurality of second fixing rotary body cleaners interposed between the temperature detector and the plurality of separation pawls in the direction of rotation of the fixing rotary body and contacting the outer circumferential surface of the fixing rotary body to clean the outer circumferential surface of the fixing rotary body.

This specification further describes an improved image forming apparatus. In one exemplary embodiment of the present invention, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
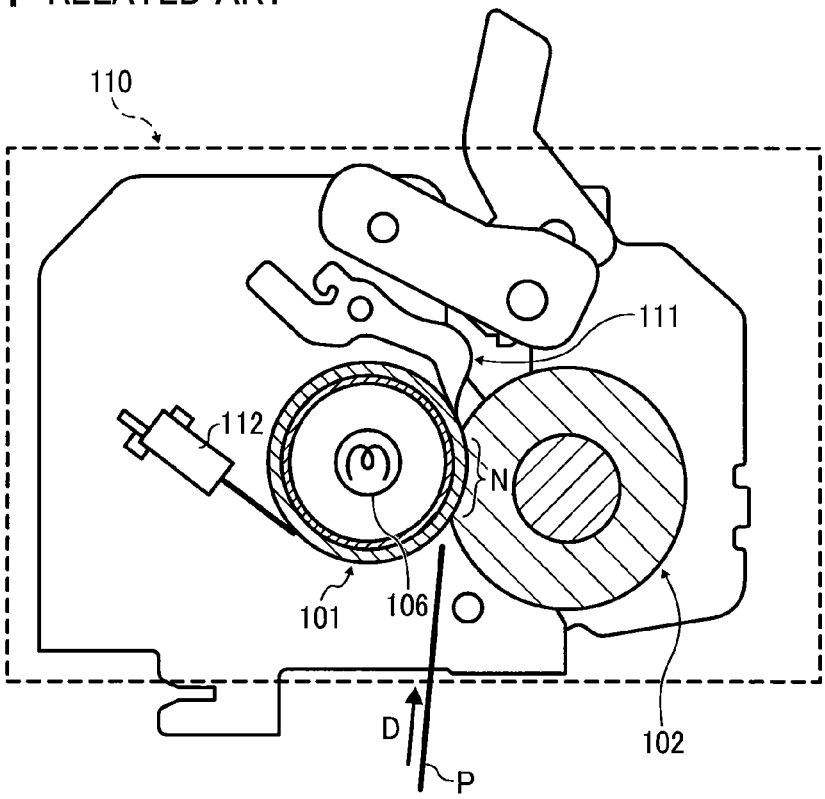
FIG. 1 RELATED ART
FIG. 1 is a schematic vertical sectional view of a related-art fixing device.
Figure 2:
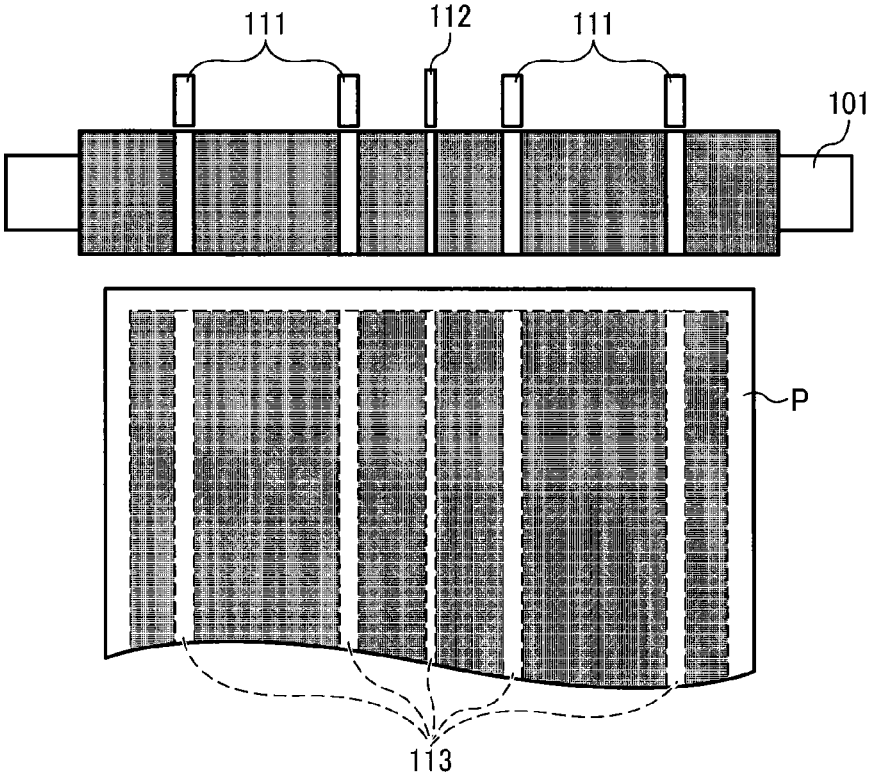
FIG. 2 RELATED ART
FIG. 2 illustrates a horizontal side view of a fixing roller incorporated in the related-art fixing device shown in FIG. 1 and a plan view of a recording medium bearing a toner image fixed by the related-art fixing device.
Figure 3:
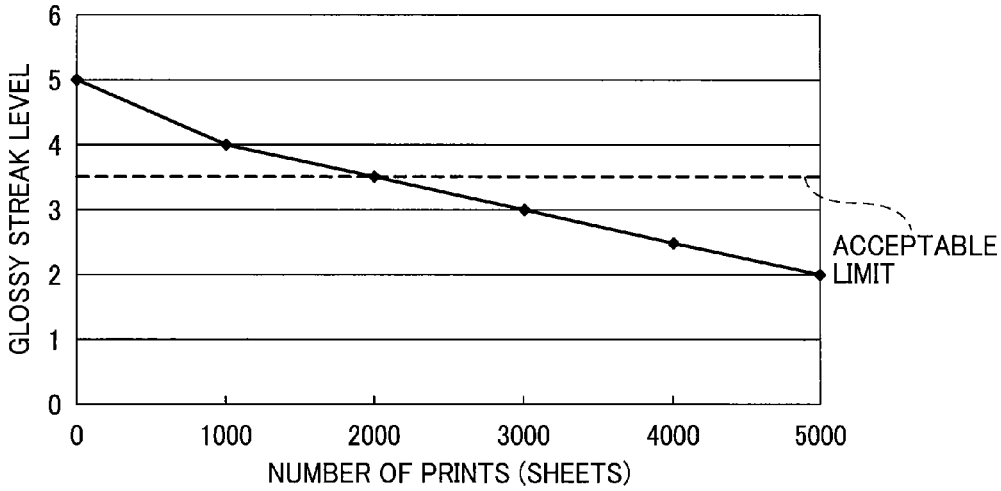
FIG. 3 RELATED ART
FIG. 3 is a graph illustrating a relation between the number of prints performed by the related-art fixing device shown in FIG. 1 and the level of glossy streaks that appear on the recording medium shown in FIG. 2.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Figure 4:
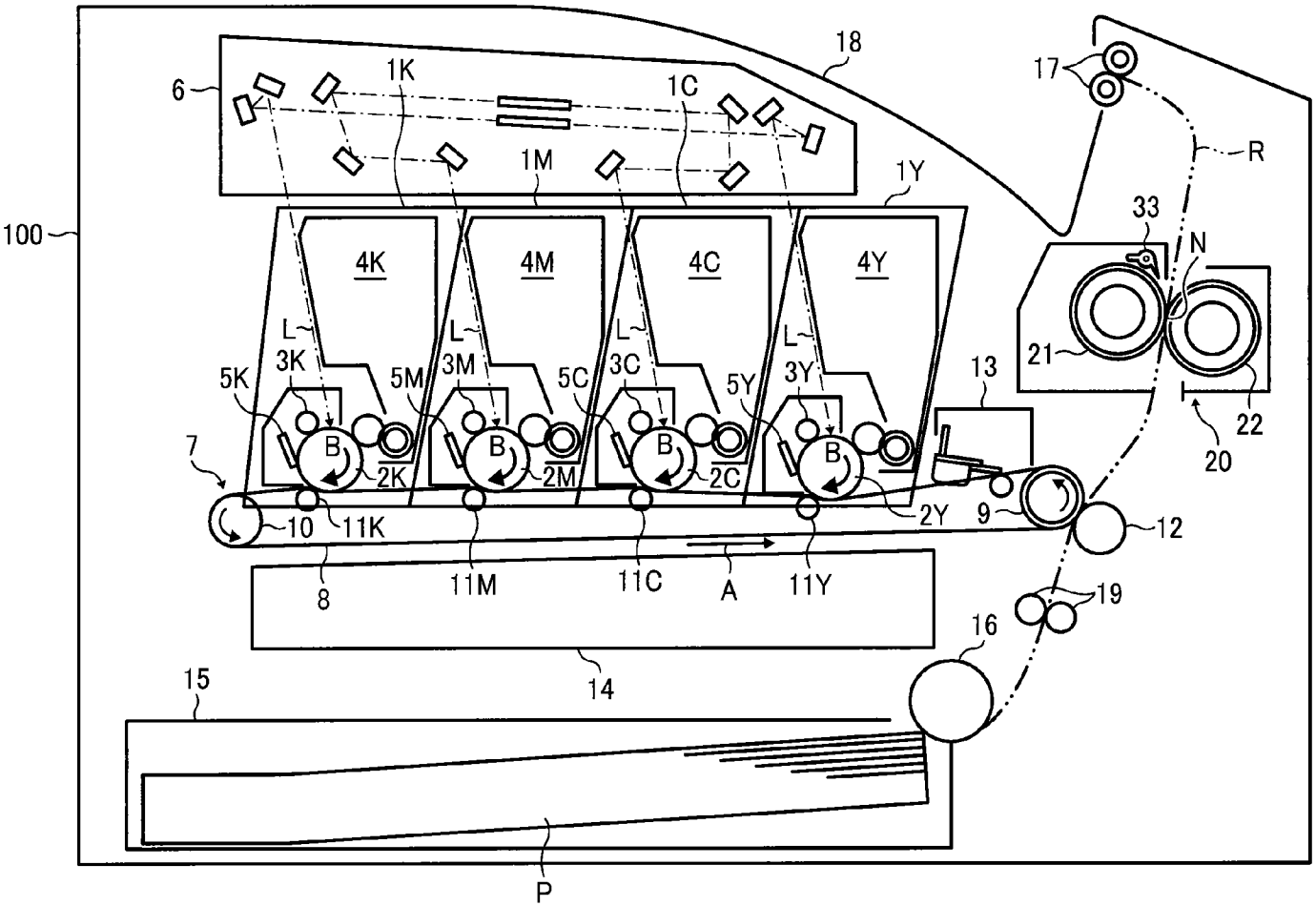
FIG. 4 is a schematic vertical sectional view of an image forming apparatus according to an exemplary embodiment of the present invention.

Referring now to the drawings, wherein like reference numerals designate identical or corresponding parts throughout the several views, in particular to FIG. 4, an image forming apparatus 100 according to an exemplary embodiment of the present invention is explained.

FIG. 4 is a schematic vertical sectional view of the image forming apparatus 100. The image forming apparatus 100 may be a copier, a facsimile machine, a printer, a multifunction printer having at least one of copying, printing, scanning, plotter, and facsimile functions, or the like. According to this exemplary embodiment, the image forming apparatus 100 is a printer for forming color and monochrome toner images on a recording medium by electrophotography.

Referring to FIG. 4, the following describes the structure of the image forming apparatus 100.

The image forming apparatus 100 includes four process units 1Y, 1C, 1M, and 1K detachably attached to the image forming apparatus 100. Although the process units 1Y, 1C, 1M, and 1K contain yellow, cyan, magenta, and black toners that form yellow, cyan, magenta, and black toner images, respectively, resulting in a color toner image, they have an identical structure. Hence, the following describes the structure of one of them, that is, the process unit 1Y that forms a yellow toner image.

For example, the process unit 1Y includes a photoconductive drum 2Y, that is, a photoconductor, serving as an image carrier that carries an electrostatic latent image and a resultant yellow toner image; a charging roller 3Y serving as a charger that charges an outer circumferential surface of the photoconductive drum 2Y; a development device 4Y serving as a development unit that supplies a developer (e.g., yellow toner) to the electrostatic latent image formed on the outer circumferential surface of the photoconductive drum 2Y, thus visualizing the electrostatic latent image into a yellow toner image with the yellow toner; and a cleaning blade 5Y serving as a cleaner that cleans the outer circumferential surface of the photoconductive drum 2Y.

Above the process units 1Y, 1C, 1M, and 1K is an exposure device 6 serving as an exposure unit that emits a laser beam L onto the outer circumferential surface of the respective photoconductive drums 2Y, 2C, 2M, and 2K to form an electrostatic latent image thereon. Below the process units 1Y, 1C, 1M, and 1K is a transfer unit 7 that accommodates an endless intermediate transfer belt 8 serving as a transferor, a driving roller 9, a driven roller 10, four primary transfer rollers 11Y, 11C, 11M, and 11K, a secondary transfer roller 12, and a belt cleaner 13. Specifically, the endless intermediate transfer belt 8 is stretched over the driving roller 9 and the driven roller 10 and rotatable in a rotation direction A.

Inside a loop formed by the intermediate transfer belt 8 and opposite the four photoconductive drums 2Y, 2C, 2M, and 2K are the four primary transfer rollers 11Y, 11C, 11M, and 11K serving as primary transferors that transfer the yellow, cyan, magenta, and black toner images formed on the photoconductive drums 2Y, 2C, 2M, and 2K onto an outer circumferential surface of the intermediate transfer belt 8. The primary transfer rollers 11Y, 11C, 11M, and 11K contact an inner circumferential surface of the intermediate transfer belt 8 and press the intermediate transfer belt 8 against the photoconductive drums 2Y, 2C, 2M, and 2K at opposed positions where the primary transfer rollers 11Y, 11C, 11M, and 11K are disposed opposite the photoconductive drums 2Y, 2C, 2M, and 2K, respectively, via the intermediate transfer belt 8, thus forming primary transfer nips between the photoconductive drums 2Y, 2C, 2M, and 2K and the intermediate transfer belt 8 where the yellow, cyan, magenta, and black toner images formed on the photoconductive drums 2Y, 2C, 2M, and 2K are primarily transferred onto the intermediate transfer belt 8 to form a color toner image thereon. Opposite the driving roller 9 is the secondary transfer roller 12 serving as a secondary transferor that transfers the color toner image formed on the intermediate transfer belt 8 onto a recording medium P. The secondary transfer roller 12 contacts the outer circumferential surface of the intermediate transfer belt 8 and presses the intermediate transfer belt 8 against the driving roller 9, thus forming a secondary transfer nip between the secondary transfer roller 12 and the intermediate transfer belt 8 where the color toner image formed on the intermediate transfer belt 8 is transferred onto the recording medium P.

The belt cleaner 13, disposed opposite the outer circumferential surface of the intermediate transfer belt 8 and in proximity to the secondary transfer nip, cleans the outer circumferential surface of the intermediate transfer belt 8. Below the intermediate transfer unit 7 is a waste toner container 14 that collects waste toner conveyed from the belt cleaner 13 through a waste toner conveyance tube extending from the belt cleaner 13 to an inlet of the waste toner container 14.

In a lower portion of the image forming apparatus 100 are a paper tray 15 that loads a plurality of recording media P (e.g., sheets) and a feed roller 16 that picks up and feeds a recording medium P from the paper tray 15 toward the secondary transfer nip formed between the secondary transfer roller 12 and the intermediate transfer belt 8. In an upper portion of the image forming apparatus 100 are an output roller pair 17 that discharges the recording medium P onto an outside of the image forming apparatus 100 and an output tray 18 that receives and stocks the recording medium P discharged by the output roller pair 17.

The recording medium P fed by the feed roller 16 is conveyed upward through a conveyance path R that extends from the paper tray 15 to the output roller pair 17. The conveyance path R is provided with a registration roller pair 19 disposed below the secondary transfer nip formed between the secondary transfer roller 12 and the intermediate transfer belt 8, that is, upstream from the secondary transfer nip in a recording medium conveyance direction. The conveyance path R is also provided with a fixing device 20 disposed downstream from the secondary transfer roller 12 and upstream from the output roller pair 17 in the recording medium conveyance direction. The fixing device 20 fixes the color toner image on the recording medium P. For example, the fixing device 20 includes a fixing roller 21 serving as a fixing rotary body; a pressing roller 22 serving as an opposed rotary body that contacts the fixing roller 21 to form a fixing nip N therebetween; and a plurality of separation pawls 33 serving as a separator that separates the recording medium P from the fixing roller 21.

Referring to FIG. 4, the following describes the operation of the image forming apparatus 100 having the structure described above to form a color toner image on a recording medium P.

As a print job starts, a driver drives and rotates the photoconductive drums 2Y, 2C, 2M, and 2K of the process units 1Y, 1C, 1M, and 1K, respectively, clockwise in FIG. 4 in a rotation direction B. The charging rollers 3Y, 3C, 3M, and 3K uniformly charge the outer circumferential surface of the respective photoconductive drums 2Y, 2C, 2M, and 2K at a predetermined polarity. The exposure device 6 emits laser beams L onto the charged outer circumferential surface of the respective photoconductive drums 2Y, 2C, 2M, and 2K according to yellow, cyan, magenta, and black image data contained in image data sent from an external device (e.g., a client computer), respectively, thus forming electrostatic latent images thereon. The development devices 4Y, 4C, 4M, and 4K supply yellow, cyan, magenta, and black toners to the electrostatic latent images formed on the photoconductive drums 2Y, 2C, 2M, and 2K, visualizing the electrostatic latent images into yellow, cyan, magenta, and black toner images, respectively.

As the driving roller 9 is driven and rotated counterclockwise in FIG. 4, the driving roller 9 drives and rotates the intermediate transfer belt 8 counterclockwise in FIG. 4 in the rotation direction A. As a power supply applies a constant voltage or a constant current control voltage having a polarity opposite a polarity of the charged yellow, cyan, magenta, and black toners to the primary transfer rollers 11Y, 11C, 11M, and 11K, a transfer electric field is created at the primary transfer nips formed between the primary transfer rollers 11Y, 11C, 11M, and 11K and the photoconductive drums 2Y, 2C, 2M, and 2K, respectively. Accordingly, the yellow, cyan, magenta, and black toner images formed on the photoconductive drums 2Y, 2C, 2M, and 2K, respectively, are primarily transferred onto the intermediate transfer belt 8 successively by the transfer electric field created at the respective primary transfer nips, in such a manner that the yellow, cyan, magenta, and black toner images are superimposed on a same position on the intermediate transfer belt 8. Consequently, a color toner image is formed on the intermediate transfer belt 8.

After the primary transfer of the yellow, cyan, magenta, and black toner images from the photoconductive drums 2Y, 2C, 2M, and 2K, the cleaning blades 5Y, 5C, 5M, and 5K remove residual toner not transferred and therefore remaining on the photoconductive drums 2Y, 2C, 2M, and 2K therefrom. Then, dischargers discharge the outer circumferential surface of the respective photoconductive drums 2Y, 2C, 2M, and 2K, initializing the potential thereof so that the respective photoconductive drums 2Y, 2C, 2M, and 2K are ready for the next print job.

On the other hand, as the print job starts, the feed roller 16 is driven and rotated to feed a recording medium P from the paper tray 15 toward the registration roller pair 19 through the conveyance path R. The registration roller pair 19 feeds the recording medium P to the secondary transfer nip formed between the secondary transfer roller 12 and the driving roller 9 at a time when the color toner image formed on the intermediate transfer belt 8 reaches the secondary transfer nip. The secondary transfer roller 12 is applied with a transfer voltage having a polarity opposite a polarity of the charged yellow, cyan, magenta, and black toners of the yellow, cyan, magenta, and black toner images constituting the color toner image formed on the intermediate transfer belt 8, thus creating a transfer electric field at the secondary transfer nip. Accordingly, the yellow, cyan, magenta, and black toner images constituting the color toner image are secondarily transferred from the intermediate transfer belt 8 collectively onto the recording medium P by the transfer electric field created at the secondary transfer nip.

The recording medium P bearing the color toner image is conveyed to the fixing device 20 where the fixing roller 21 and the pressing roller 22 apply heat and pressure to the recording medium P, fixing the color toner image on the recording medium P. The separation pawls 33 separate the recording medium P bearing the fixed color toner image from the fixing roller 21. Thereafter, the output roller pair 17 discharges the recording medium P onto the output tray 18. After the secondary transfer of the color toner image from the intermediate transfer belt 8 onto the recording medium P, the belt cleaner 13 removes residual toner not transferred onto the recording medium P and therefore remaining on the intermediate transfer belt 8 therefrom. The removed toner is conveyed and collected into the waste toner container 14.

The above describes the image forming operation of the image forming apparatus 100 to form the color toner image on the recording medium P. Alternatively, the image forming apparatus 100 may form a monochrome toner image by using any one of the four process units 4Y, 4C, 4M, and 4K or may form a bicolor or tricolor toner image by using two or three of the process units 4Y, 4C, 4M, and 4K.

Referring to FIGS. 5 to 7B, the following describes the configuration of the fixing device 20 according to a first exemplary embodiment that is installed in the image forming apparatus 100 described above.

Figure 5:
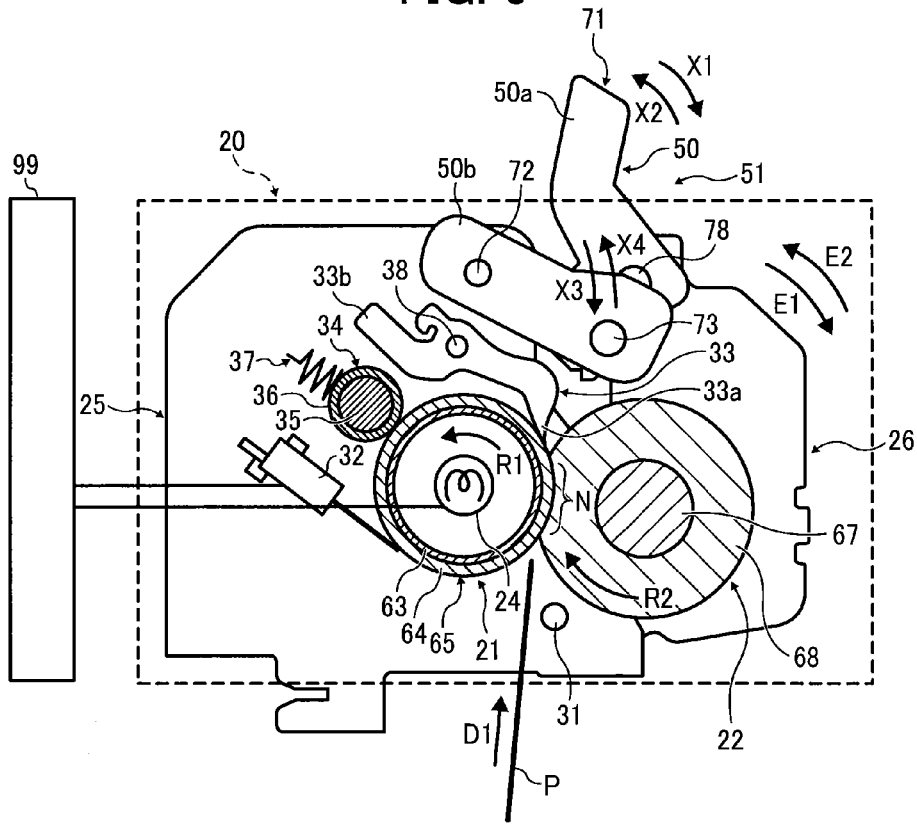
FIG. 5 is a vertical sectional view of a fixing device according to a first exemplary embodiment incorporated in the image forming apparatus shown in FIG. 4.
Figure 6:
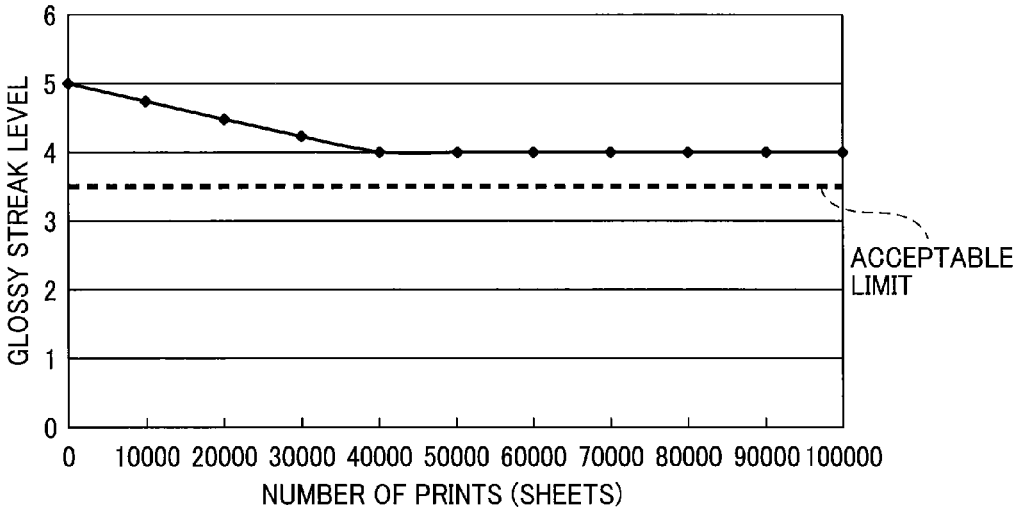
FIG. 6 is a graph illustrating a relation between the number of prints performed by the fixing device shown in FIG. 5 and the level of glossy streaks that appear on recording media.
Figure 7A:
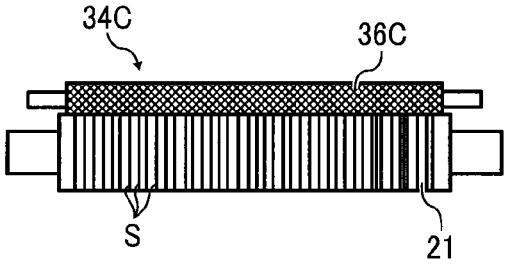
FIG. 7A is a horizontal side view of a fixing roller incorporated in the fixing device shown in FIG. 5 and a comparative fixing roller cleaner.
Figure 7B:
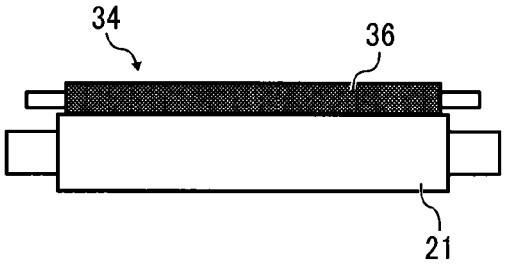
FIG. 7B is a horizontal side view of a fixing roller and a fixing roller cleaner incorporated in the fixing device shown in FIG. 5.

FIG. 5 is a vertical sectional view of the fixing device 20. FIG. 6 is a graph illustrating a relation between the number of prints performed by the fixing device 20 shown in FIG. 5 and the level of glossy streaks that appear on recording media P. FIG. 7A is a horizontal side view of the fixing roller 21 and a comparative fixing roller cleaner 34C. FIG. 7B is a horizontal side view of the fixing roller 21 and a fixing roller cleaner 34 incorporated in the fixing device 20.

As shown in FIG. 5, the fixing device 20 (e.g., a fuser unit) includes the fixing roller 21 serving as a fixing rotary body rotatable in a rotation direction R1; the pressing roller 22 serving as an opposed rotary body rotatable in a rotation direction R2 counter to the rotation direction R1 of the fixing roller 21; and a resilient member (e.g., a compression spring) that biases the pressing roller 22 against the fixing roller 21 to press the pressing roller 22 against the fixing roller 21, forming the fixing nip N therebetween.

Alternatively, at least one of the fixing rotary body and the opposed rotary body may be an endless belt formed into a loop inside which a roller or a pad is disposed in such a manner that the roller or the pad presses the endless belt against another one of the fixing rotary body and the opposed rotary body. Further, the opposed rotary body may not press against the fixing rotary body but may merely contact the fixing rotary body.

The fixing device 20 uses toner containing wax as a releasing agent that facilitates separation of toner of the toner image formed on the recording medium P from the fixing roller 21. Accordingly, it is not necessary to coat the fixing roller 21 with oil.

The fixing device 20 further includes a lever switcher 51 that switches between an enhanced pressure state in which the pressing roller 22 presses against the fixing roller 21 with enhanced pressure and a reduced pressure state in which the pressing roller 22 presses against the fixing roller 21 with reduced pressure by moving a lever assembly 50 connected to the pressing roller 22 and the fixing roller 21. The fixing roller 21 is supported by a fixing frame 25; the pressing roller 22 is supported by a pressing frame 26. That is, the fixing roller 21 is rotatably mounted on the fixing frame 25; the pressing roller 22 is rotatably mounted on the pressing frame 26. The pressing frame 26 mounted with the pressing roller 22 is rotatable about a shaft 31 mounted on the fixing frame 25. The resilient member (e.g., a compression spring) attached to the fixing frame 25 and the pressing frame 26 exerts a resilient bias to the fixing frame 25 and the pressing frame 26, thus pressing the pressing roller 22 supported by the pressing frame 26 against the fixing roller 21 supported by the fixing frame 25 to form the fixing nip N between the pressing roller 22 and the fixing roller 21. The resilient member has a spring load of about 65 N; the fixing nip N has a nip load of about 340 N.

The fixing roller 21 includes a tubular body 65 constructed of a thermal conductive base layer 63 and an outer layer 64 coating the base layer 63. A heater 24 (e.g., a halogen heater) is disposed inside the tubular body 65. The outer layer 64 of the tubular body 65 is constructed of an elastic layer and a surface layer coating the elastic layer.

The thermal conductive base layer 63, having a predetermined mechanical strength, is made of thermal conductive carbon steel or aluminum. The elastic layer of the outer layer 64 is made of synthetic rubber such as silicone rubber and fluoro rubber. The surface layer of the outer layer 64 is made of materials with high thermal conductivity and durability that facilitate separation of toner of a toner image on a recording medium P from the fixing roller 21 and enhance the durability of the elastic layer. For example, the surface layer of the outer layer 64 may be a tetrafluoroethylene-perfluoroalkylvinylether copolymer (PFA) tube, a layer coated with fluoroplastic such as PFA, or a layer cladded with silicone rubber or fluoro rubber.

The fixing roller 21 has an outer loop diameter in a range of from about 15 mm to about 40 mm. The elastic layer of the outer layer 64 has a thickness in a range of from about 0.5 mm to about 3.0 mm. The surface layer of the outer layer 64 has a thickness in a range of from about 10 micrometers to about 80 micrometers. According to this exemplary embodiment, the fixing roller 21 has an outer loop diameter of about 24 mm. The elastic layer of the outer layer 64 has a thickness of about 1 mm and the surface layer of the outer layer 64 has a thickness of about 43 micrometers.

The pressing roller 22 includes a metal core 67 and an outer layer 68 coating the metal core 67. The outer layer 68 is constructed of an elastic layer and a surface layer coating the elastic layer. For example, the metal core 67 is made of carbon steel tubes for machine structural purposes (STKM). The elastic layer of the outer layer 68 is made of silicone rubber, fluoro rubber, silicone rubber foam, fluoro rubber foam, or the like. The surface layer of the outer layer 68 is made of a heat resistant fluoroplastic tube, such as PFA and polytetrafluoroethylene (PTFE), which facilitates separation of toner of the toner image on the recording medium P from the pressing roller 22.

The pressing roller 22 has an outer loop diameter in a range of from about 20 mm to about 40 mm. The elastic layer of the outer layer 68 has a thickness in a range of from about 0.5 mm to about 10.0 mm. The surface layer of the outer layer 68 has a thickness in a range of from about 10 micrometers to about 80 micrometers. According to this exemplary embodiment, the pressing roller 22 has an outer loop diameter of about 30 mm. The elastic layer of the outer layer 68 has a thickness of about 8 mm and the surface layer of the outer layer 68 has a thickness of about 50 micrometers.

The lever assembly 50 of the lever switcher 51 includes a link assembly 71 constructed of a first linkage 50*a* and a second linkage 50*b*. One end, that is, a left end in FIG. 5, of the second linkage 50*b* (e.g., a lever arm) in a longitudinal direction thereof is pivotally mounted on the fixing frame 25 by a pin 72. Another end, that is, a right end in FIG. 5, of the second linkage 50*b* in the longitudinal direction thereof is pivotally mounted on the first linkage 50*a* by a pin 73. One end of the first linkage 50*a* (e.g., a lever arm) in a longitudinal direction thereof is pivotally mounted on the pressing frame 26 by a pin 78.

As the first linkage 50*a* of the lever assembly 50 swings about the pin 78 in a direction X1, since the first linkage 50*a* is coupled to the second linkage 50*b* through the pin 73, the second linkage 50*b* swings about the pin 72 in a direction X4. Accordingly, the pressing frame 26 swings about the shaft 31 in a direction E1. Consequently, the pressing roller 22 presses against the fixing roller 21 with reduced pressure therebetween, producing the shorter fixing nip N in a recording medium conveyance direction D1.

Conversely, as the first linkage 50*a* of the lever assembly 50 swings about the pin 78 in a direction X2, the second linkage 50*b* of the lever assembly 50 swings about the pin 72 in a direction X3. Accordingly, the pressing frame 26 swings about the shaft 31 in a direction E2. Consequently, the pressing roller 22 presses against the fixing roller 21 with enhanced pressure therebetween, producing the longer fixing nip N in the recording medium conveyance direction D1.

The separation pawls 33, a thermistor 32 serving as a temperature detector that detects the temperature of the fixing roller 21, and a thermostat that prevents overheating of the fixing roller 21 are disposed opposite an outer circumferential surface of the fixing roller 21. As a controller 99, that is, a microprocessor, for example, operatively connected to the thermistor 32 and the heater 24 receives a detection signal from the thermistor 32, the controller 99 controls the heater 24 based the detection signal sent from the thermistor 32, maintaining the temperature of the fixing roller 21 at a predetermined temperature range. An entry guide, disposed upstream from the fixing nip N in the recording medium conveyance direction D1, guides the recording medium P to the fixing nip N. An exit guide, disposed downstream from the fixing nip N in the recording medium conveyance direction D1, guides the recording medium P discharged from the fixing nip N toward the output roller pair 17 depicted in FIG. 4. The separation pawls 33 disposed downstream from the fixing nip N in the recording medium conveyance direction D1 separate the recording medium P bearing the fixed toner image discharged from the fixing nip N from the fixing roller 21.

Figure 12:
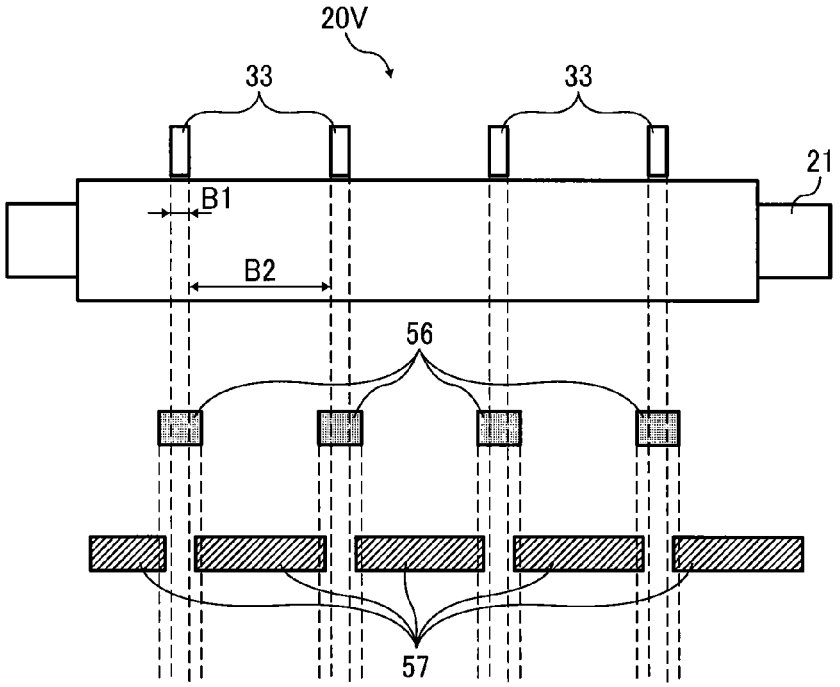
FIG. 12 is a schematic development view of the fixing device shown in FIG. 11.

The separation pawls 33 serving as a separator are disposed opposite the outer circumferential surface of the fixing roller 21 at a position downstream from the fixing nip N in the recording medium conveyance direction D1. As shown in FIG. 12 illustrating a horizontal side view of the fixing roller 21 and the separation pawls 33, according to this exemplary embodiment, the four separation pawls 33 are aligned in an axial direction of the fixing roller 21. However, the number of the separation pawls 33 is not limited to four as long as the plurality of separation pawls 33 is disposed opposite the outer circumferential surface of the fixing roller 21. As shown in FIG. 5, each separation pawl 33 is supported by a shaft 38 in such a manner that each separation pawl 33 is rotatable about the shaft 38 independently from other separation pawls 33. As the separation pawl 33 rotates about the shaft 38 clockwise in FIG. 5, a front end 33*a* of the separation pawl 33 is brought into contact with the outer circumferential surface of the fixing roller 21. Conversely, as the separation pawl 33 rotates about the shaft 38 counterclockwise in FIG. 5, the front end 33*a* of the separation pawl 33 separates from the outer circumferential surface of the fixing roller 21. FIG. 5 illustrates the separation pawl 33 in contact with the fixing roller 21.

The separation pawl 33 is made of PFA, polyetherketone (PEK), polyether ether ketone (PEEK), or the like that facilitates separation from and sliding over the fixing roller 21. Alternatively, an outer circumferential surface of the separation pawl 33 may be coated with PFA or Teflon® that facilitates separation from and sliding over the fixing roller 21.

A contact direction resilient member is attached to a base 33*b* of each separation pawl 33 disposed opposite the front end 33*a*. The contact direction resilient member biases the separation pawl 33 against the fixing roller 21, bringing the separation pawl 33 into contact with the fixing roller 21. The base 33*b* of each separation pawl 33 is also attached with a separation pawl separator that separates the separation pawl 33 from the fixing roller 21.

The fixing roller cleaner 34 serving as a fixing rotary body cleaner contacts the outer circumferential surface of the fixing roller 21 at a position where the separation pawl 33 and the thermistor 32 do not contact the outer circumferential surface of the fixing roller 21. The fixing roller cleaner 34 is disposed downstream from the separation pawl 33 and upstream from the thermistor 32 in the rotation direction R1 of the fixing roller 21. Specifically, the fixing roller cleaner 34 contacts the outer circumferential surface of the fixing roller 21 at the position shifted by a predetermined angle in a circumferential direction, that is, the rotation direction R1, of the fixing roller 21 from a position where the separation pawl 33 contacts the outer circumferential surface of the fixing roller 21.

The thermistor 32 contacts the outer circumferential surface of the fixing roller 21 at the position upstream from the fixing nip N in the rotation direction R1 of the fixing roller 21. By contrast, the separation pawl 33 contacts the outer circumferential surface of the fixing roller 21 at the position downstream from the fixing nip N in the rotation direction R1 of the fixing roller 21. The fixing roller cleaner 34 contacts the outer circumferential surface of the fixing roller 21 at the position interposed between the separation pawl 33 and the thermistor 32 in the rotation direction R1 of the fixing roller 21.

For example, the fixing roller cleaner 34 is a tube constructed of a core shaft 35 and a cleaner body 36 coating the core shaft 35 and contacting the outer circumferential surface of the fixing roller 21 to clean it. The fixing roller cleaner 34 is rotatable about an axis thereof in accordance with rotation of the fixing roller 21. As shown in FIG. 7B, the fixing roller cleaner 34 has a width equivalent to a width of the fixing roller 21 in the axial direction thereof and therefore contacts the outer circumferential surface of the fixing roller 21 throughout substantially the entire width of the fixing roller 21 in the axial direction thereof. Bearings biased toward the fixing roller 21 by compression springs 37 depicted in FIG. 5 support both lateral ends of the fixing roller cleaner 34, respectively. The compressing springs 37 press the fixing roller cleaner 34 against the fixing roller 21 with pressure in a range of from about 5 N to about 40 N, for example, about 12 N according to this exemplary embodiment. If the pressure is smaller than about 5 N, the fixing roller cleaner 34 may not remove an adherent adhered from the recording medium P onto the fixing roller 21, such as a slight amount of offset toner and paper dust adhered from the recording medium P onto the fixing roller 21, from the fixing roller 21. Conversely, if the pressure is greater than about 40 N, the fixing roller cleaner 34 may damage the PFA tube, that is, the surface layer of the outer layer 64 of the fixing roller 21.

The fixing roller cleaner 34 has a diameter in a range of from about 6 mm to about 20 mm with a thickness of the cleaner body 36 in a range of from about 0.1 mm to about 2.0 mm. According to this exemplary embodiment, the core shaft 35 has a diameter of about 10 mm and the cleaner body 36 has a thickness of about 1 mm.

The core shaft 35 may be made of free-cutting steel (SUM). According to this exemplary embodiment, the cleaner body 36 is made of artificial leather. For example, a sliced face of artificial leather uniformly contacts the outer circumferential surface of the fixing roller 21. Weight per unit area of artificial leather is in a range of from about 200 g/m$^2$ to about 400 g/m$^2$, for example, about 305 g/m$^2$ according to this exemplary embodiment.

Referring to FIGS. 5 and 6, the following describes glossy streaks that appear on the toner image on the recording medium P. As the recording medium P bearing the toner image passes through the fixing nip N, an adherent such as a slight amount of offset toner and paper dust may adhere from the recording medium P to the fixing roller 21. As the separation pawls 33 and the thermistor 32 slide over the fixing roller 21, they scrape toner adhered to the fixing roller 21 off the fixing roller 21. However, toner adhered to the fixing roller 21 remains on the fixing roller 21 at positions where the separation pawls 33 and the thermistor 32 do not contact the fixing roller 21, producing streaks of toner on the fixing roller 21. As the fixing roller 21 rotates in the rotation direction R1, the streaks of toner on the fixing roller 21 are transferred onto a subsequent recording medium P passing through the fixing nip N, producing glossy streaks on the recording medium P. To address this problem, the fixing device 20 has the fixing roller cleaner 34 that cleans the fixing roller 21. FIG. 6 illustrates a graph showing the relation between the number of prints performed by the fixing device 20 and the level of glossy streaks that appear on recording media P. The greater the glossy streak level, the smaller the amount of glossy streaks that appear on the recording media P. By contrast, the smaller the glossy streak level, the greater the amount of glossy streaks that appear on the recording media P. The dotted line defines the acceptable limit of the glossy streak level of 3.5. As shown in FIG. 6, even when 100,000 sheets are printed, the glossy streak level is maintained at 4 greater than the acceptable limit of 3.5. That is, the fixing device 20 attains a lifespan of more than 100,000 prints.

Referring to FIGS. 7A and 7B, the following describes a comparison between the comparative fixing roller cleaner 34C with a comparative cleaner body 36C made of felt and the fixing roller cleaner 34 with the cleaner body 36 made of artificial leather. Table below shows the specification and evaluation of the comparative cleaner body 36C and the cleaner body 36 according to this exemplary embodiment.

| | | Felt of comparative cleaner body 36C | Artificial leather of cleaner body 36 |
|---|---|---|---|
| Specification | Material | Aramid fiber | polyester 65% polyurethane 35% |
| | Fiber diameter | 14 μm | 5 μm (ultrathin polyester fiber) |
| | Weight per unit area | 400 g/m$^2$ to 1,000 g/m$^2$ | 200 g/m$^2$ to 400 g/m$^2$ |
| | Surface | Brushed | Smoothly sliced |
| Evaluation | | Producing fine scratches on the outer circumferential surface of the fixing roller 21 Producing fine streaks on the toner image on the recording medium P | No fine scratches on the outer circumferential surface of the fixing roller 21 |

Felt of the comparative cleaner body 36C of the comparative fixing roller cleaner 34C is made of aramid fibers constituting a brushed surface and has a greater weight per unit area in a range of from about 400 g/m$^2$ to about 1,000 g/m$^2$. Accordingly, the brushed surface of the aramid fibers may produce fine scratches S on the outer circumferential surface of the fixing roller 21 that are transferred onto the toner image on the recording medium P as fine streaks. By contrast, artificial leather of the cleaner body 36 of the fixing roller cleaner 34 is made of ultrathin polyester fibers having a diameter of about 5 micrometers and has weight per unit area in a range of from about 200 g/m$^2$ to about 400 g/m$^2$ smaller than that of felt. A mechanically sliced face of artificial leather is not brushed and therefore contacts the outer circumferential surface of the fixing roller 21 uniformly without scratching it. Accordingly, the cleaner body 36 of the fixing roller cleaner 34 effectively removes an adherent such as a slight amount of offset toner and paper dust adhered from the recording medium P to the fixing roller 21.

Consequently, the image forming apparatus 100 depicted in FIG. 4 that incorporates the fixing device 20 attaining the advantages described above can form a high quality toner image on the recording medium P.

Figure 8:
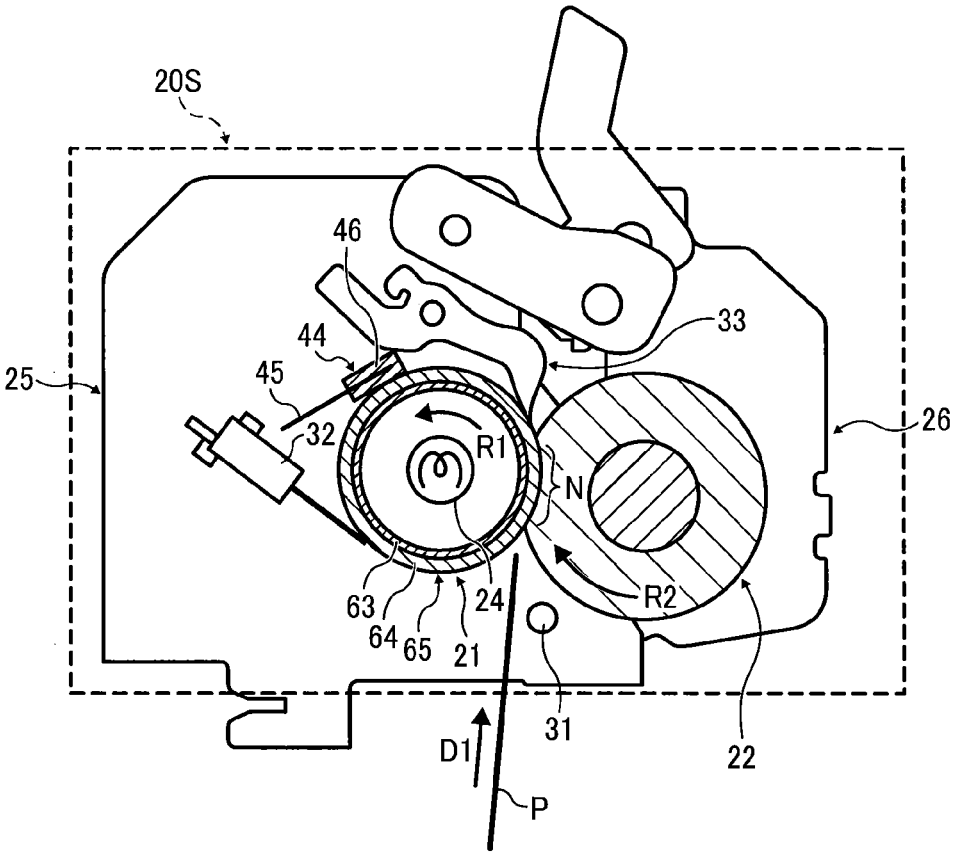
FIG. 8 is a vertical sectional view of a fixing device according to a second exemplary embodiment.

Referring to FIG. 8, the following describes a fixing device 20S according to a second exemplary embodiment.

FIG. 8 is a vertical sectional view of the fixing device 20S. Unlike the fixing device 20 depicted in FIG. 5 that has the rotatable fixing roller cleaner 34, the fixing device 20S has a non-rotatable fixing roller cleaner 44. For example, the fixing roller cleaner 44 includes a plate spring 45 and a cleaning pad 46 attached to a front end of the plate spring 45 and pressed against the outer circumferential surface of the fixing roller 21 by the plate spring 45, thus contacting the outer circumferential surface of the fixing roller 21. The cleaning pad 46 has a thickness in a range of from about 0.1 mm to about 2.0 mm. According to this exemplary embodiment, the plate spring 45 has a thickness of about 0.1 mm; the cleaning pad 46 has a thickness of about 1.0 mm. The fixing roller cleaner 44 has a width not smaller than a width of a maximum recording medium P in the axial direction of the fixing roller 21.

The plate spring 45 is made of SUS stainless steel; the cleaning pad 46 is made of artificial leather. The cleaning pad 46 has weight per unit area of about 305 g/m$^2$. A sliced face of artificial leather of the cleaning pad 46 uniformly contacts the outer circumferential surface of the fixing roller 21.

The plate spring 45 biases the cleaning pad 46 against the fixing roller 21 with pressure in a range of from about 2 N to about 10 N. If the pressure is smaller than about 2 N, the fixing roller cleaner 44 may not remove an adherent, such as a slight amount of offset toner and paper dust adhered from a recording medium P to the fixing roller 21, from the fixing roller 21. Conversely, if the pressure is greater than about 10 N, the fixing roller cleaner 44 may damage the PFA tube, that is, the surface layer of the outer layer 64 of the fixing roller 21. To address this circumstance, according to this exemplary embodiment, the pressure is about 3.5 N.

Figure 9:
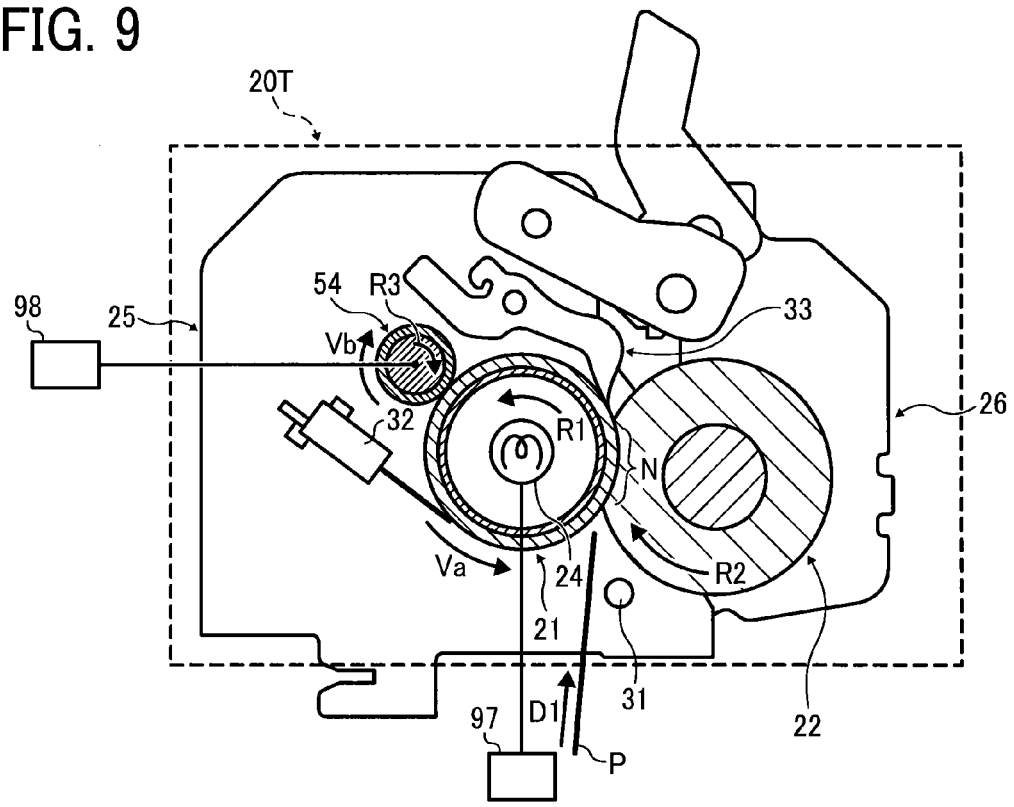
FIG. 9 is a vertical sectional view of a fixing device according to a third exemplary embodiment.

Referring to FIG. 9, the following describes a fixing device 20T according to a third exemplary embodiment.

FIG. 9 is a vertical sectional view of the fixing device 20T. Unlike the fixing device 20 depicted in FIG. 5 that has the fixing roller cleaner 34 rotatable in accordance with rotation of the fixing roller 21, the fixing device 20T according to the third exemplary embodiment has a fixing roller cleaner 54 rotatable independently from the fixing roller 21. For example, the fixing roller cleaner 54 is driven and rotated by a driver 98 (e.g., a motor) that rotates the fixing roller cleaner 54 exclusively in a rotation direction R3 at a rotation speed Vb different from a rotation speed Va of the fixing roller 21 driven and rotated by a driver 97 (e.g., a motor), thus improving cleaning performance of the fixing roller cleaner 54 that cleans the outer circumferential surface of the fixing roller 21.

Figure 10:
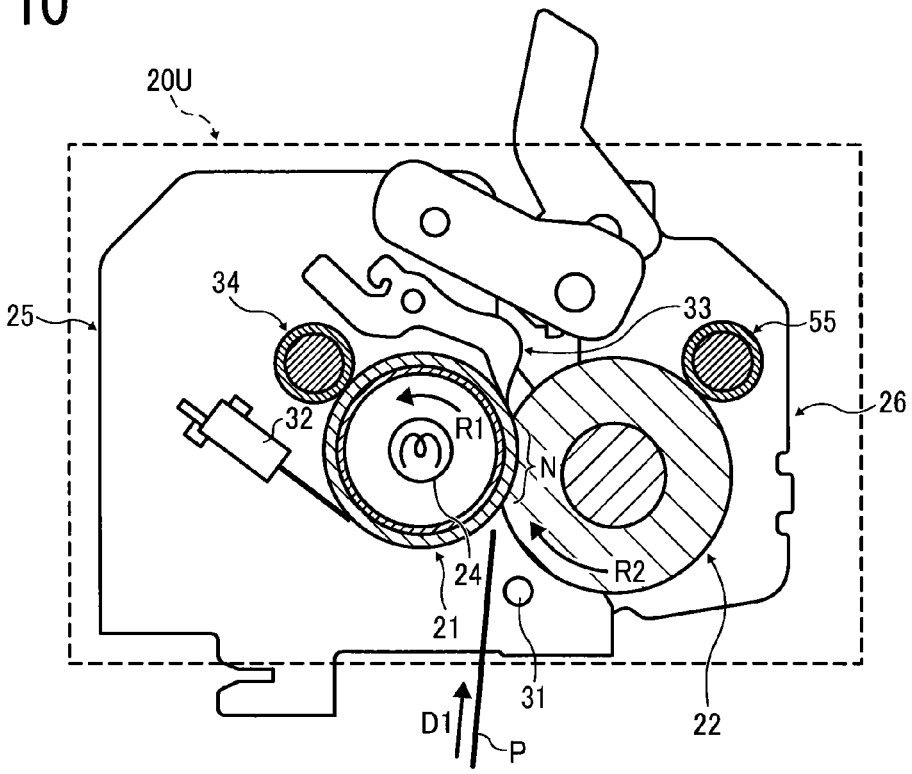
FIG. 10 is a vertical sectional view of a fixing device according to a fourth exemplary embodiment.

Referring to FIG. 10, the following describes a fixing device 20U according to a fourth exemplary embodiment.

FIG. 10 is a vertical sectional view of the fixing device 20U. In addition to the fixing roller cleaner 34, the fixing device 20U includes a pressing roller cleaner 55 that contacts an outer circumferential surface of the pressing roller 22 to clean it. The pressing roller cleaner 55 has a configuration identical to that of the fixing roller cleaner 34 described above with reference to FIGS. 5 and 7B. The pressing roller cleaner 55 may be rotatable in accordance with rotation of the pressing roller 22 that rotates in the rotation direction R2, may be rotatable independently from the pressing roller 22, or may not be rotatable. Accordingly, the pressing roller cleaner 55 removes an adherent, such as a slight amount of offset toner and paper dust adhered from the recording medium P onto the pressing roller 22, from the pressing roller 22, thus reducing glossy streaks produced on the toner image on the subsequent recording medium P due to transfer of the adherent from the pressing roller 22 onto the subsequent recording medium P.

Figure 11:
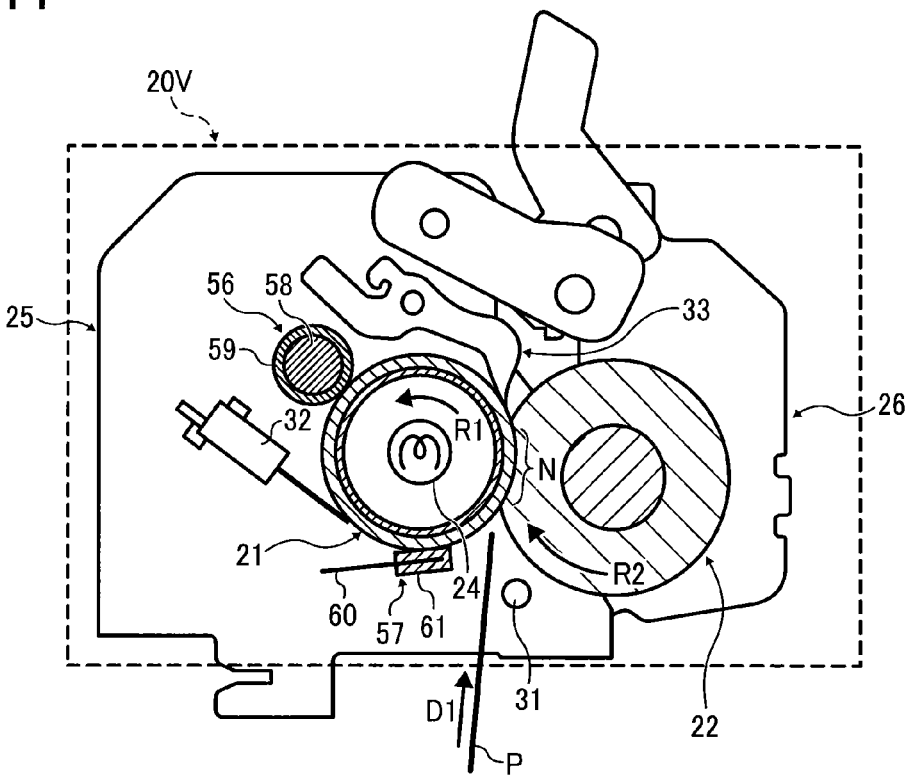
FIG. 11 is a vertical sectional view of a fixing device according to a fifth exemplary embodiment.

Referring to FIGS. 11 and 12, the following describes a fixing device 20V according to a fifth exemplary embodiment.

FIG. 11 is a vertical sectional view of the fixing device 20V. FIG. 12 is a schematic development view of the fixing device 20V. The fixing device 20V includes two fixing roller cleaners, that is, a first fixing roller cleaner 56 and a second fixing roller cleaner 57 that contact the outer circumferential surface of the fixing roller 21 to clean it. For example, the first fixing roller cleaner 56 is disposed downstream from the separation pawl 33 and upstream from the thermistor 32 in the rotation direction R1 of the fixing roller 21. The second fixing roller cleaner 57 is disposed downstream from the thermistor 32 and upstream from the fixing nip N in the rotation direction R1 of the fixing roller 21. The first fixing roller cleaner 56 is a small tube that includes a core shaft 58 and a cleaner body 59 coating the core shaft 58 and contacting the outer circumferential surface of the fixing roller 21 to clean it. Unlike the fixing roller cleaner 34 depicted in FIG. 5 that contacts the fixing roller 21 throughout substantially the entire width of the fixing roller 21 in the axial direction thereof, each first fixing roller cleaner 56 is disposed opposite a first band B1 on the outer circumferential surface of the fixing roller 21 contacted by the separation pawl 33 as shown in FIG. 12. Hence, four first fixing roller cleaners 56 are aligned in the axial direction of the fixing roller 21.

Each second fixing roller cleaner 57 includes a plate spring 60 and a cleaning pad 61 attached to a front end of the plate spring 60 and contacting the outer circumferential surface of the fixing roller 21. As shown in FIG. 12, each second fixing roller cleaner 57 is disposed opposite a second band B2 on the outer circumferential surface of the fixing roller 21 not contacted by the first fixing roller cleaner 56. Accordingly, the second fixing roller cleaners 57 remove an adherent, such as a slight amount of offset toner and paper dust adhered from the recording medium P onto the fixing roller 21, at a position on the outer circumferential surface of the fixing roller 21 where the separation pawls 33 are not disposed opposite the fixing roller 21. Consequently, the adherent is not transferred to the subsequent recording medium P conveyed through the fixing nip N, reducing glossy streaks produced on a toner image on the subsequent recording medium P.

The present invention is not limited to the details of the exemplary embodiments described above, and various modifications and improvements are possible. For example, the image forming apparatus 100 may be a copier, a printer, a facsimile machine, a multifunction printer having at least one of copying, printing, facsimile, and scanning functions, or the like. According to the exemplary embodiments described above, the four separation pawls 33 are aligned in the axial direction of the fixing roller 21 as shown in FIG. 12. Alternatively, an arbitrary number of separation pawls 33 not smaller than two is available.

Referring to FIGS. 5, 8, 9, 10, 11, and 12, the following describes advantages of the fixing devices 20, 20S, 20T, 20U, and 20V.

The fixing devices 20, 20S, 20T, 20U, and 20V include a fixing rotary body (e.g., the fixing roller 21) rotatable in the rotation direction R1; an opposed rotary body (e.g., the pressing roller 22) to contact the fixing rotary body to form the fixing nip N therebetween through which a recording medium P bearing a toner image is conveyed; a plurality of separation pawls (e.g., the separation pawls 33) to separatably contact an outer circumferential surface of the fixing rotary body to separate the recording medium P discharged from the fixing nip N from the fixing rotary body; a temperature detector (e.g., the thermistor 32) to contact the outer circumferential surface of the fixing rotary body to detect the temperature of the fixing rotary body; and a fixing rotary body cleaner (e.g., the fixing roller cleaners 34, 44, 54, and 56) interposed between the plurality of separation pawls and the temperature detector in the rotation direction R1 of the fixing rotary body and contacting the outer circumferential surface of the fixing rotary body. For example, the fixing rotary body cleaner contacts the outer circumferential surface of the fixing rotary body at a position thereon shifted from a position where the plurality of separation pawls contacts the outer circumferential surface of the fixing rotary body by a predetermined angle in a circumferential direction, that is, the rotation direction R1 of the fixing rotary body.

With this configuration, the fixing roller cleaner removes an adherent, such as a slight amount of offset toner and paper dust adhered from the recording medium P conveyed through the fixing nip N onto the fixing rotary body, from the fixing rotary body, thus minimizing glossy streaks that may appear on the toner image on the subsequent recording medium P due to transfer of the adherent from the fixing rotary body to the subsequent recording medium P. Further, even if toner caught and accumulated by the plurality of separation pawls and the temperature detector may fall onto the fixing rotary body, the fixing roller cleaner collects the fallen toner from the fixing rotary body, preventing the fallen toner from adhering to the subsequent recording medium P and therefore staining the subsequent recording medium P.

As shown in FIG. 4, the image forming apparatus 100 incorporates any one of the fixing devices 20, 20S, 20T, 20U, and 20V, attaining the advantages described above.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotary body rotatable in a predetermined direction of rotation;

an opposed rotary body contacting the fixing rotary body to form a fixing nip therebetween through which a recording medium bearing a toner image is conveyed;

a plurality of separation pawls separatably contacting an outer circumferential surface of the fixing rotary body to separate the recording medium discharged from the fixing nip from the fixing rotary body;

a temperature detector contacting the outer circumferential surface of the fixing rotary body to detect a temperature of the fixing rotary body;

a plurality of first fixing rotary body cleaners interposed between the plurality of separation pawls and the temperature detector in the direction of rotation of the fixing rotary body and contacting the outer circumferential surface of the fixing rotary body to clean the outer circumferential surface of the fixing rotary body; and a plurality of second fixing rotary body cleaners interposed between the temperature detector and the plurality of separation pawls in the direction of rotation of the fixing rotary body and contacting the outer circumferential surface of the fixing rotary body to clean the outer circumferential surface of the fixing rotary body.

2. The fixing device according to claim 1, wherein each of the plurality of first fixing rotary body cleaners has a width equivalent to a portion of a width of the fixing rotary body in an axial direction of the fixing rotary body.

3. The fixing device according to claim 1, wherein at least one of the plurality of first fixing rotary body cleaners is made of artificial leather.

4. The fixing device according to claim 3, wherein the artificial leather of the at least one of the plurality of first fixing rotary body cleaners has a weight per unit area in a range of from about 200 $g/m^2$ to about 400 $g/m^2$.

5. The fixing device according to claim 3, wherein the artificial leather of the at least one of the plurality of first fixing rotary body cleaners has a sliced face that contacts the outer circumferential surface of the fixing rotary body.

6. The fixing device according to claim 1, wherein each of the plurality of first fixing rotary body cleaners includes a tube that rotates in accordance with rotation of the fixing rotary body.

7. The fixing device according to claim 1, further comprising a driver connected to the plurality of first fixing rotary body cleaners to drive the plurality of first fixing rotary body cleaners exclusively to rotate the plurality of first fixing rotary body cleaners independently from the fixing rotary body at a first rotation speed different from a second rotation speed of the fixing rotary body.

8. The fixing device according to claim 1, wherein each of the plurality of second fixing rotary body cleaners includes:

a plate spring; and a cleaning pad attached to the plate spring and pressed against the outer circumferential surface of the fixing rotary body by the plate spring.

9. The fixing device according to claim 1, further comprising an opposed rotary body cleaner contacting an outer circumferential surface of the opposed rotary body to clean the outer circumferential surface of the opposed rotary body.

10. The fixing device according to claim 1, wherein the fixing rotary body includes a fixing roller and the opposed rotary body includes a pressing roller.

11. The fixing device according to claim 1, wherein the plurality of first fixing rotary body cleaners is aligned in an axial direction of the fixing rotary body and each of the plurality of first fixing rotary body cleaners is disposed opposite a first band on the outer circumferential surface of the fixing rotary body where each of the plurality of separation pawls contacts the outer circumferential surface of the fixing rotary body, and wherein the plurality of second fixing rotary body cleaners is aligned in the axial direction of the fixing rotary body and each of the plurality of second fixing rotary body cleaners is disposed opposite a second band on the outer circumferential surface of the fixing rotary body where each of the plurality of separation pawls does not contact the outer circumferential surface of the fixing rotary body.

12. The fixing device according to claim 1, wherein each of the plurality of first fixing rotary body cleaners includes a tube that rotates in accordance with rotation of the fixing rotary body, and wherein each of the plurality of second fixing rotary body cleaners includes:

a plate spring; and a cleaning pad attached to the plate spring and pressed against the outer circumferential surface of the fixing rotary body by the plate spring.

13. An image forming apparatus comprising:

at least one process unit that forms the toner image on the recording medium; and the fixing device according to claim 1.

14. The fixing device according to claim 1, wherein a portion of each of the plurality of first fixing rotary body cleaners that contacts the outer circumferential surface of the fixing rotary body is a continuous surface with a width that is equivalent to a portion of an entire width of the fixing rotary body.

* * * * *